United States Patent [19]

Ando

[11] Patent Number: 4,467,305

[45] Date of Patent: Aug. 21, 1984

[54] GAS/VAPOR COOLED ELECTROMAGNETIC INDUCTION MACHINE

[75] Inventor: Nobuyoshi Ando, Itami, Japan

[73] Assignee: Mitsubishi Denki Kabushiki Kaisha, Tokyo, Japan

[21] Appl. No.: 431,084

[22] Filed: Sep. 30, 1982

[30] Foreign Application Priority Data

Oct. 12, 1981 [JP] Japan ..... 56-162249

[51] Int. Cl.[3] ..... H01F 27/08

[52] U.S. Cl. ..... 336/55; 336/57; 336/58; 336/94; 336/179; 174/14 R; 174/15 R

[58] Field of Search ..... 336/55, 57, 58, 94, 336/179; 174/14 R, 15 R

[56] References Cited

U.S. PATENT DOCUMENTS

| | | | |
|---|---|---|---|
| 2,440,930 | 5/1948 | Camilli et al. | 336/55 X |
| 2,746,020 | 5/1956 | Lautenberger | 336/55 |
| 3,629,758 | 12/1971 | Pearce | 336/57 |
| 4,321,421 | 3/1982 | Pierce | 336/57 X |

FOREIGN PATENT DOCUMENTS

| | | | |
|---|---|---|---|
| 678892 | 9/1952 | United Kingdom | 336/55 |

*Primary Examiner*—J. V. Truhe
*Assistant Examiner*—S. Steward
*Attorney, Agent, or Firm*—Wenderoth, Lind & Ponack

[57] ABSTRACT

A gas/vapor electromagnetic induction machine comprises an annular coil container including two coaxial electrically insulating cylinders connected at lower ends to an annular bottom plate and coaxially disposed around an iron core within an enclosed tank charged with a non-condensable electrically insulating gas and a condensable cooling gas. A dripping pan receives a condensate of the cooling gas located on the lower portion of the tank through the operation of a pump and drops the condensate into the annular coil container and onto the iron core assembly located within the annular coil container. Thus a coil is always partially or entirely immersed in the condensate collected in the annular coil container.

1 Claim, 2 Drawing Figures

GAS/VAPOR COOLED ELECTROMAGNETIC INDUCTION MACHINE

BACKGROUND OF THE INVENTION

1. Field of the Invention

This invention relates to gas/vapor cooled electromagnetic induction machines such as transformers, reactors, etc.

2. Description of the Prior Art

A gas/vapor cooled electromagnetic induction machine of the conventional type comprises an enclosed tank charged with a mixture of an amount of an electrically insulating gas non-condensable at operating temperatures and under operating gas pressures, for example, gaseous sulfur hexafluoride and an amount of a cooling gas condensable at the operating temperatures and under the operating gas pressures, for example, gaseous fluorocarbon. Within the enclosed tank there are disposed an iron core, along a longitudinal or vertical axis thereof, and a coil assembly consisting of a plurality of pancake coil sections wound at predetermined equal intervals around the iron core with the coil sections put between a pair of inner and outer electrically insulating cylinders. Also a dripping pan has been located above the iron core and the coil assembly within the enclosed tank and a condenser has been connected to the tank to condense the cooling gas into a condensate which is, in turn, collected on the lower portion of the tank.

When the electromagnetic induction machine is put in operation, an associated pump is actuated to supply the condensate collected on the lower tank portion to the dripping pan. The condensate supplied to the dripping pan drops on the coil sections and the iron core through a multitude of very small holes disposed at the bottom of the dripping pan. This contact with the iron core and the coil sections causes the condensate to increase in temperature and to be vaporized. At that time the iron core and the coil sections are deprived of a latent heat of vaporization of the condensate to be cooled. Thus the enclosed tank is filled with the mixture of the electrically insulating gas and the cooling gas now put in its gaseous phase. That mixture of gases enters into the condenser where only the cooling gas is condensed into its liquid phase to dissipate the latent heat of vaporization. The resulting condensate enters into the tank and is collected on the lower portion thereof. Then the process as described above is repeated to continuously cool the iron core and the coil sections.

In gas/vapor cooled electromagnetic induction machines such as described above, the condensate is dropped on the iron core and the coil sections but the drops of the condensate contact only the outer surface of the iron core and the upper surface and inner and outer lateral surfaces of the coil section. Thus the iron core and the coil sections have been unable to be uniformly cooled resulting in the disadvantages that the cooling efficiency is poor and the coil sections may locally increase in temperature.

Accordingly it is an object of the present invention to provide a new and improved gas/vapor cooled electromagnetic induction machine including means for efficiently cooling a coil assembly which generates a greater part of heat developed on the machine, and also including means for preventing the coil assembly from locally increasing in temperature.

SUMMARY OF THE INVENTION

The present invention provides a gas/vapor cooled electromagnetic induction machine comprising an enclosed tank, an amount of an electrically insulating gas charged into the enclosed tank and non-condensable at operating temperatures and under operating gas pressure, an amount of a cooling gas charged into the enclosed tank and condensable at the operating temperatures and under the operating gas pressures, a condenser connected to the tank to condense the cooling gas into a condensate, an iron core disposed within the enclosed tank, a coil assembly wound around the iron core, a dripping pan disposed above the iron core and the coil assembly within the enclosed tank to drop the condensate on the coil assembly, a pump for supplying the condensate to the dripping pan, a container formed of a pair of inner and outer electrically insulating cylinders coaxially disposed around an inner and an outer periphery of the coil assembly, and an annular bottom plate connected to lower ends of the pair of electrically insulating cylinders to accommodate the condensate dropped from the dripping pan within the container.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
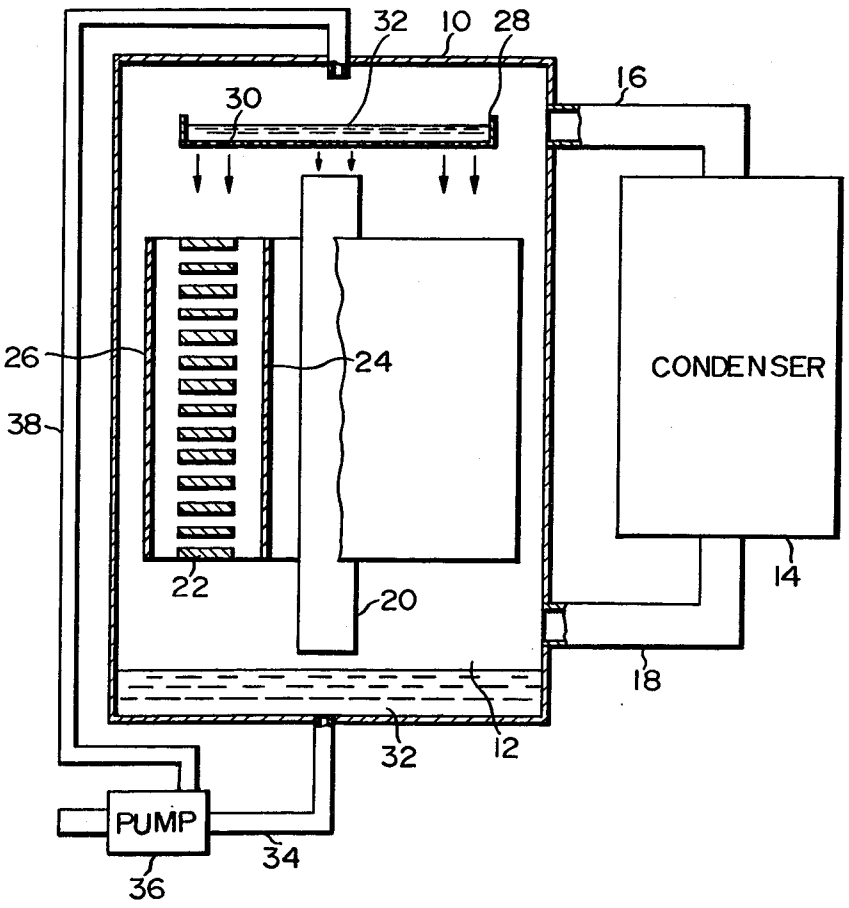
FIG. 1 PRIOR ART
FIG. 1 is a longitudinal sectional view of a conventional gas/vapor cooled electromagnetic induction machine with parts illustrated in elevation and in block diagrams.

Referring now to FIG. 1 of the drawings, there is illustrated a conventional gas/vapor cooled electromagnetic induction machine. The arrangement illustrated comprises an enclosed tank 10 in the form of a hollow cylinder hermetically closed at both ends and charged with a mixture 12 of an amount of an electrically insulating gas non-condensable at operating temperatures and under operating gas pressures, for example, gaseous sulfur hexafluoride and an amount of a cooling gas condensable at the operating temperatures and under the operating gas pressures, for example, gaseous fluorocarbon, and a condenser 14 connected to the enclosed tank 10 through a pair of upper and lower pipes 16 and 18 respectively. Within the tank 10 an iron core 20 is disposed on the longitudinal axis thereof and a coil assembly formed of a plurality of coil sections 22 disposed at predetermined equal intervals to be axially aligned with one another and coaxially wound around the iron core 20. A pair of inner and outer electrically insulating cylinders 24 and 26 respectively are disposed coaxially with the axially aligned coil sections 22 to enclose the inner and outer peripheries thereof respectively to form an annular space coaxial with the iron core 20 with narrow spacing formed between each of the cylinders 24 or 26 and coil sections 22.

Then a dripping pan 28 is disposed above the iron core 220 and the axially aligned coil sections 22 within the enclosed tank 10 with a multitude of small holes 30 provided at the bottom thereof. Collected on the lower portion of the enclosed tank 10 is a condensate 32 into which the cooling gas has been condensed by the condenser 14. The tank 10 is connected at the bottom to a pipe 34 subsequently connected to a pump 36 disposed below the tank 10. The pump 36 is connected to a pipe 38 opening in the tank 10 above the central portion of the dripping pan 28.

When the arrangement of FIG. 1 is operated, the iron core 20 and the coil sections 22 generate heat to increase temperatures until the insulation of the coil sections 22 may be deteriorated. In order to cool the iron core 20 and the coil sections 22, the condensate 32 disposed on the lower portion of the tank 10 is supplied to the dripping pan 28 by the pump 36 and drops on the iron core 20 and the coil sections 22 as droplets. Those droplets contact the iron core 20 and the coil sections 22, are increased in temperature, and are vaporized thereby to remove a latent heat of vaporation of the condensate therefrom resulting in the cooling of the iron core 20 and coil sections 22. Thus the enclosed tank 10 is filled with the mixture 12 of the electrically insulating gas and the cooling gas now put in its gaseous phase. That mixture 12 is entered via the upper pipe 16 into the condenser 14 where it is cooled until only the cooling gas dissipates the latent heat of vaporization and is condensed into its liquid phase. The resulting condensate flows out from the condenser 14 through the lower pipe 18 and is collected on the lower portion of the tank 10. Thereafter the process as described above is repeated to continuously cool the iron core 20 and the coil sections 22.

In conventional gas/vapor cooled electromagnetic induction machine such as described above, the droplets from the dripping pan 28 can not fall on the entire outer surfaces of the iron core 20 and the coil sections 22. In other words, the droplets of the condensate 22 contact only the outer surface of the iron core 20 and the upper surface, the inner and outer lateral surfaces of the coil sections 22 so that the iron core 20 and the coil sections 22 are not uniformly cooled resulting in the disadvantage that the cooling efficiency is poor. Also the coil sections 22 might locally increase in temperature.

The present invention contemplates eliminating the disadvantages of the prior art practice as described above by the provision of a container including an annular bottom plate for closing the bottom of the annular spacing defined by the inner and outer electrically insulating cylinders as described above whereby the coil sections are partly or entirely immersed into the condensate collected in the container.

Figure 2:
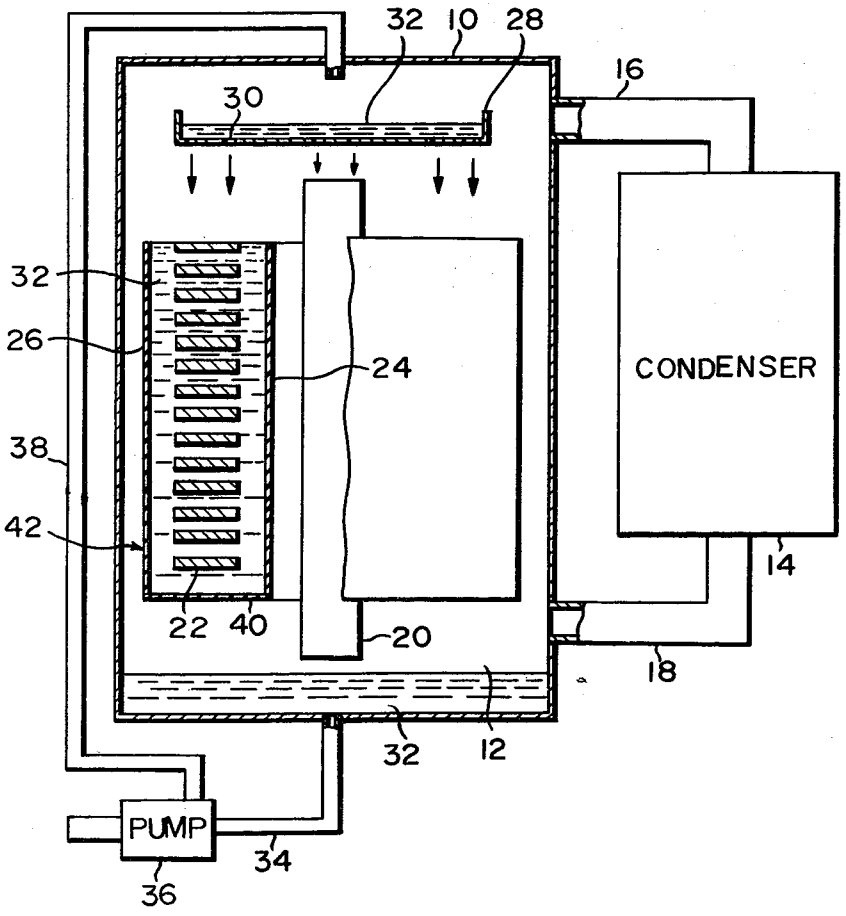
FIG. 2 is a longitudinal sectional view of one embodiment according to the gas/vapor cooled electromagnetic induction machine of the present invention with parts illustrated in elevation and in block diagrams.

Referring now to FIG. 2 wherein like reference numerals designate the components identical to those shown in FIG. 1, there is illustrated one embodiment according to the gas/vapor cooled electromagnetic induction machine of the present invention. The arrangement illustrated is different from that shown in FIG. 1 only in that in FIG. 2 an annular bottom plate 40 is connected to the lower ends of the inner and outer electrically insulating cylinders 24 and 26 respectively to form a container 42 in which the coil sections 22 are accommodated and the condensate dropped from the dripping pan 28 is collected. Thus the coil sections 22 are always partly or entirely immersed in the condensate collected in the container 42.

As in the arrangement illustrated in FIG. 1, the pump 36 is operated to supply the condensate 32 located on the lower portion of the tank 10 to the dripping pan 28 which, in turn drops droplets on the iron core 20 and the coil sections 22. At that time, however, the condensate 32 drops in a large amount on the coil sections 22 as compared with the arrangement shown in FIG. 1.

Since the annular bottom plate 40 is connected to the bottoms of the inner and outer cylinders 24 and 26 disposed on the inner and outer sides of the axially aligned coil sections 22 to form the container 42 with both cylinders, the coil sections 22 are always partly or entirely immersed in the condensate 32 collected in the container 42 as described above. This measure improves the conduction of heat generated on the coil sections 22 to the condensate 32 resulting in the efficient cooling of the coil sections 22 through the removal of a latent heat of vaporization of the condensate 32 therefrom.

From the foregoing it is seen that, according to the present invention, the bottom plate 40 is connected to lower ends of the coaxial electrically insulating cylinders 24 and 26 putting the axially aligned coil sections 22 therebetween to form the container 42 in which the condensate 32 is collected and the coil sections 22 are immersed in that condensate 32. The condensate 32 then overflows from the top of the container 42 and drops into the bottom of the tank 10. Therefore, the efficient cooling is not only attained but also the temperature of the coil sections 22 can be prevented from rising locally.

While the present invention has been illustrated and described in conjunction with a single preferred embodiment thereof, it is to be understood that numerous changes and modifications may be resorted to without departing from the spirit and scope of the present invention.

What is claimed is:

1. A gas/vapor cooled electromagnetic induction machine comprising:

an enclosed tank having an amount of an electrically insulating gas charged into said enclosed tank and non-condensable at operating temperatures and under operating pressures, and also having an amount of a cooling gas charged in said enclosed tank and condensable at the operating temperatures and under the operating pressures, a condenser connected to said enclosed tank to condense said cooling gas into a condensate, an iron core disposed within said enclosed tank, a coil assembly wound around said iron core, a dripping pan means, located in the upper portion of the enclosed tank, for dropping said condensate on said coil assembly and said iron core, a pump means for supplying said condensate to said dripping pan, and a container having a pair of electrically insulating cylinders disposed around an inner and an outer periphery of said coil assembly and also having a bottom plate means for collecting said condensate dropped from said dripping pan within the enclosed tank, whereby the coil assembly is always partly or entirely immersed in the condensate collected in the container, thus improving the conduction of heat generated on the coil assembly and resulting in the efficient cooling of the coil assembly through the removal of a latent heat of vaporization of the condensate therefrom and also resulting in preventing the coil assembly from rising locally in temperature.

* * * * *